US006980077B1

(12) United States Patent
Chandrasekaran et al.

(10) Patent No.: US 6,980,077 B1
(45) Date of Patent: Dec. 27, 2005

(54) COMPOSITE MAGNETIC CORE FOR SWITCH-MODE POWER CONVERTERS

(75) Inventors: Sriram Chandrasekaran, Burbank, CA (US); Vivek Mehrotra, Newbury Park, CA (US); Jian Sun, Clifton Park, NY (US)

(73) Assignee: ColdWatt, Inc., Austin, TX (US)

( * ) Notice: Subject to any disclaimer, the term of this patent is extended or adjusted under 35 U.S.C. 154(b) by 0 days.

(21) Appl. No.: 10/922,068

(22) Filed: Aug. 19, 2004

(51) Int. Cl.[7] ..... H01F 27/24
(52) U.S. Cl. ..... 336/212; 336/233
(58) Field of Search ..... 336/83, 212–215, 336/233–234

(56) References Cited

U.S. PATENT DOCUMENTS

| | | | | |
|---|---|---|---|---|
| 3,433,998 | A * | 3/1969 | Wolber | 315/393 |
| 3,622,868 | A * | 11/1971 | Todt | 323/250 |
| 5,126,714 | A | 6/1992 | Johnson | |
| 5,134,771 | A * | 8/1992 | Lee et al. | 29/609 |
| 5,335,163 | A * | 8/1994 | Seiersen | 363/126 |
| 5,784,266 | A | 7/1998 | Chen | |
| 6,348,848 | B1 | 2/2002 | Herbert | |
| 6,362,986 | B1 | 3/2002 | Schultz et al. | |
| 6,549,436 | B1 | 4/2003 | Sun | |
| 2002/0114172 | A1 | 8/2002 | Webb et al. | |

FOREIGN PATENT DOCUMENTS

| | | |
|---|---|---|
| JP | 3215911 | 9/1991 |

OTHER PUBLICATIONS

Xu, et al., Design of 48V Voltage Regulator Modules with a Novel Integrated Magnetics, IEEE Transactions on Power Electronics, vol. 17, No. 6 (Nov. 2002), pp. 990-998.

* cited by examiner

*Primary Examiner*—Tuyen T Nguyen
(74) *Attorney, Agent, or Firm*—Slater & Matsil, L.L.P.

(57) ABSTRACT

A composite magnetic core formed of a high permeability material and a lower permeability, high saturation flux density material prevents core saturation without an air gap and reduces eddy current losses and loss of inductance. The composite core is configured such that the low permeability, high saturation material is located where the flux accumulates from the high permeability sections. The presence of magnetic material having a relatively high permeability keeps the flux confined within the core thereby preventing fringing flux from spilling out into the winding arrangement. This composite core configuration balances the requirements of preventing core saturation and minimizing eddy current losses without increasing either the height or width of the core or the number of windings.

21 Claims, 8 Drawing Sheets

COMPOSITE MAGNETIC CORE FOR SWITCH-MODE POWER CONVERTERS

BACKGROUND OF THE INVENTION

1. Field of the Invention

This invention relates to switch-mode power converters and more specifically to an improved magnetic core structure that reduces the fringing flux and winding eddy current losses by eliminating the air gap.

2. Description of the Related Art

Switch-mode power converters are key components in many military and commercial systems for the conversion, control and conditioning of electrical power and they often govern size and performance. Power density, efficiency and reliability are key metrics used to evaluate power converters. Transformers and inductors used within these power converters constitute a significant percentage of their volume and weight, hence determine their power density, specific power, efficiency and reliability.

Gapping of magnetic cores is standard practice for inductor assemblies to provide localized energy storage and prevent core saturation. The air gap can withstand very high magnetic fields, hence supports the applied magnetomotive force almost entirely and provides local energy storage. Due to its low permeability compared to the core material, the air gap increases the overall magnetic reluctance of the core thereby maintaining the flux and the flux density below the saturation limits of the core material. The high permeability core material provides a path for the closure of the magnetic flux lines and also houses the winding turns to generate the required magnetomotive force in the core.

Integrated magnetics provides a technique to combine multiple inductors and/or transformers in a single magnetic core. It is amenable to interleaved current multiplier topologies where the input or output current is shared between multiple inductors. Integrated magnetics offers several advantages such as improved power density and reduced cost due to elimination of discrete magnetic components, reduced switching ripple in inductor currents over a discrete implementation and higher efficiency due to reduced magnetic core and copper losses. Planar magnetics, where transformer and inductor windings are synthesized as copper traces on a multi-layer printed circuit board (PCB) offer several advantages, especially for low-power dc—dc converter applications, such as low converter profile, improved power density and reliability, reduced cost, and close coupling between the windings.

The integrated magnetics assembly 10 shown in FIG. 1 for a current-doubler rectifier (CDR) comprises an E-core 12 and plate 14 wound with split-primary windings 16 and 18, secondary windings 20 and 22, and an inductor winding 24 (See U.S. Pat. No. 6,549,436). This assembly integrates a transformer and three inductors in a single E-core. As a result, the magnetic flux in the core consists of transformer and inductive components. The center leg of the E-core is in the inductive flux path, hence is gapped to prevent core saturation and provide energy storage. A high permeability path is maintained for a transformer flux component to ensure good magnetic coupling between the primary and secondary windings. The inductive flux components flow through the outer legs 26, 28, and the center leg 30, the low permeability air gap 32, and complete through the top plate 14 and the base 30. The transformer component of the flux circulates in the outer legs 26 and 28, the top plate 14 and the base 30, which form a high permeability path around the E-core 12. The center-leg winding is used to increase the effective filtering inductance and carries the full load current continuously.

As shown in FIGS. 2*a* and 2*b*, the integrated magnetics assembly 10 is implemented using planar windings synthesized with a multi-layer PCB 33 having copper traces that form horizontal windings in the plane of the PCB. E-core 12 is positioned underneath the PCB so that its outer legs 26 and 28 extend through holes in the PCB that coincide with the centers of primary and secondary windings 16 and 20 and 18 and 22, respectively, and its center leg 30 extends through a hole that coincides with inductor winding 24. Plate 14 rests on the outer legs forming the requisite air gap 32 with the center leg.

Inductance is primarily determined by the core reluctance and the number of turns. Since the relative permeability of air is negligible compared to that of the core material, the reluctance, along the inductive flux path, of an E-core with a gapped center leg is dominated by that of the air gap. One limitation on the cross sectional area of the center leg and hence of the air gap is fringing flux. Like bright light from one room leaking under a door into a dark second room, a portion of the flux from the air gap 32 spills onto the width of the core window 36 and impinges on the planar windings therein. This is schematically illustrated in FIG. 3. The fringing flux lines 34 are normal to the plane of the windings on the PCB 33, as shown in FIG. 4, resulting in the induction of large eddy currents 38 in the windings. Fringing flux affects converter metrics in two ways. (i) It induces eddy currents in the planar windings, which result in $I^2R$ losses and poor efficiency (ii) Reduced inductance due to loss of flux from the main magnetic path. One way to reduce the eddy currents is to place the planar windings a safe distance away from the air gap. To do this, the outer legs may be far from the center leg, thereby making the window wider, or the outer legs may be made taller, thereby increasing the height of core window 36 so that the windings may be positioned closer to the base and far enough away from the air gap 32. These two solutions result in either a wider E-core or a taller E-core, both of which result in reduced power density and poor utilization of the core volume. If the number of planar PCB layers increases to accommodate more turns for higher inductance, it may become inevitable that some of the winding layers be close enough to the air gap 32 that they will suffer from high eddy current losses due to the strong fringing flux.

Loss of inductance due to fringing flux results in increased switching ripple and hence higher $I^2R$ losses in the windings and the semiconductor devices. In addition, a higher output capacitance is required to accommodate the higher inductor current ripple resulting in reduced power density.

SUMMARY OF THE INVENTION

The present invention provides a magnetic core that reduces the fringing flux resulting in lower eddy current losses for both planar and vertical winding structures and reduces inductance loss while preventing core saturation.

This is accomplished with a composite core without an air gap, formed of two materials, one with high permeability and the second with lower permeability than the first material and high saturation flux density to provide energy storage. The composite core is configured such that the low permeability, high saturation material is located where the magnetic flux accumulates from the high permeability sections of the core. The low permeability and high saturation flux density of the magnetic material allows it to withstand high magnetic fields without saturation and provide localized energy storage similar to an air gap.

The presence of magnetic material having relatively high permeability as compared to air in the space where the air gap would have existed does a better job of keeping the flux confined within the core thereby preventing fringing flux from spilling out onto the winding arrangement. Introduction of the low permeability material with a finite saturation flux density to replace the air gap requires careful design of the complete core to ensure that the flux density at each section of the core, in response to the applied magnetic field, does not exceed the saturation limit of the corresponding material used to synthesize that section.

The permeabilities of the two materials that form the composite core should differ significantly to ensure that the energy is stored primarily in the low permeability section of the core. A typical permeability ratio between the two materials is about 20:1, while a ratio of 10:1 is adequate to achieve satisfactory performance. A wide variation in permeability results in the applied magnetomotive force to be almost entirely supported in the low permeability section of the composite core.

The composite core may be configured in any number of ways to implement winding structures for integrated magnetics in both isolated and non-isolated power converters. The core may be synthesized through conventional "E-I" or "E—E" structures or custom structures such as coupled toroids and matrix integrated magnetics (MIM) structures such as a "+", "radial" or "Extended-E". In non-isolated converters using integrated magnetics where multiple inductors share one core, the base, top plate and/or the center leg or portions thereof may be formed from the low permeability material. In isolated converter topologies using integrated magnetics where one magnetic core is shared between multiple transformers and inductors, a high permeability path for the transformer component of the flux has to be made available thereby allowing all or a portion of only the center leg to be formed of the low permeability material.

These and other features and advantages of the invention will be apparent to those skilled in the art from the following detailed description of preferred embodiments, taken together with the accompanying drawings, in which:

DETAILED DESCRIPTION OF THE INVENTION

The present invention provides a magnetic core that reduces the fringing flux for both planar and vertical winding structures thereby lowering eddy current losses and loss of inductance.

Although air is an ideal gapping material from the perspective of preventing core saturation since it can support very high magnetic fields, it results in fringing flux due to its very low permeability compared to that of core materials. Air has a relative permeability of one and does not saturate. In other words its saturation flux density is infinite. When the flux encounters an air gap in its magnetic path, a portion spills out of the air gap and impinges on the planar winding assembly inducing undesirable eddy currents. The fringing flux results in loss of inductance, which results in increased switching ripple leading to higher losses in the windings and semiconductor devices.

The ideal material would have both an infinite saturation flux density to prevent core saturation and a high permeability to produce a desired inductance for a given number of windings thereby suppressing fringing flux. Unfortunately this ideal material does not exist.

Figure 5:
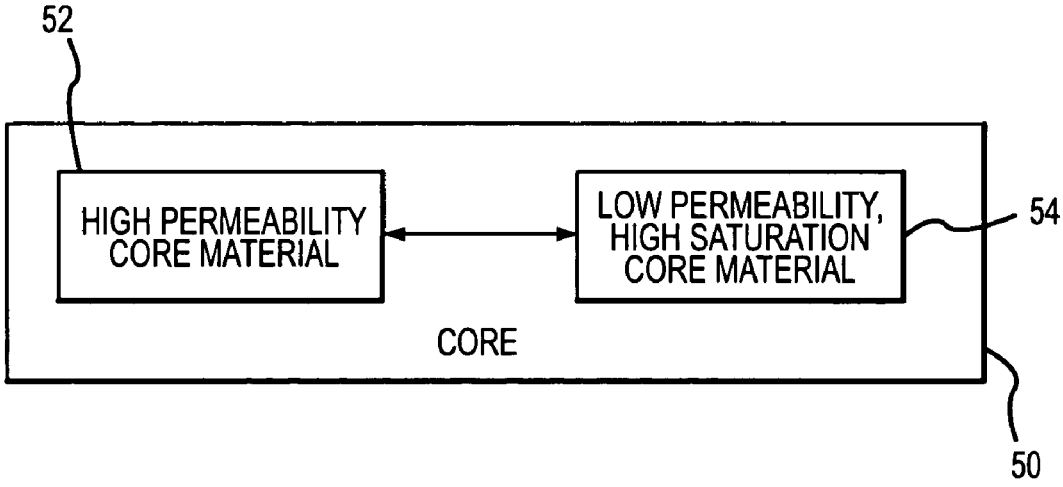
FIG. 5, as described above, is a block diagram of a composite core in accordance with the present invention.
Figure 6A:
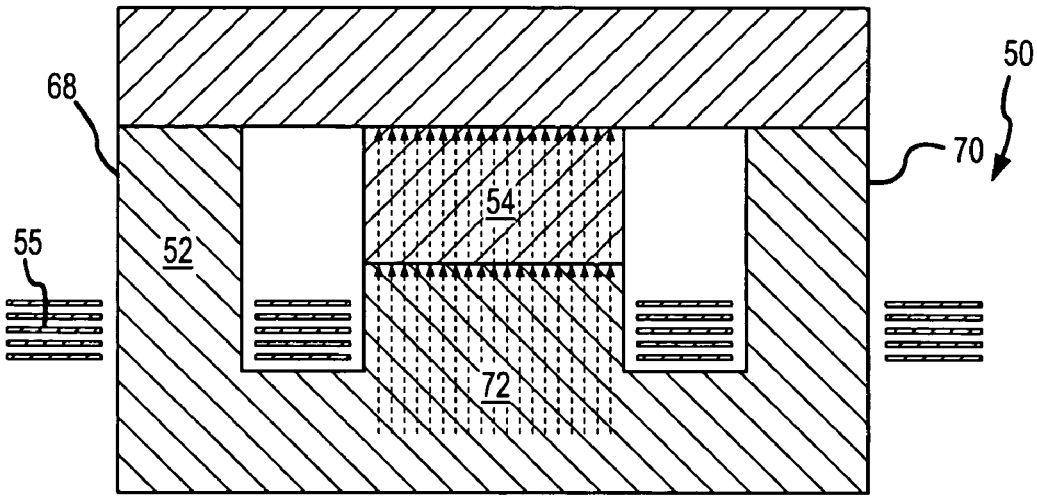
FIGS. 6*a* and 6*b* are section views of a composite core from a conventional E-I structure showing the confinement of the magnetic flux within the core volume for both planar and vertical winding arrangements.
Figure 6B:
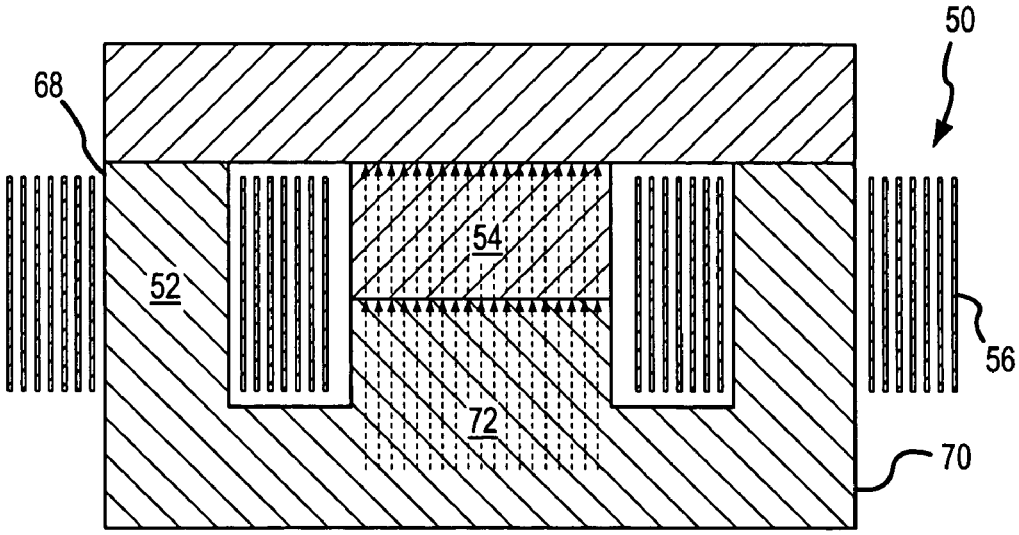

As illustrated schematically in FIG. 5, in accordance with the present invention a composite core 50 is formed of a high permeability material 52 and a low permeability, high saturation material 54 without an air gap. As with any magnetic core, the high permeability section of the core houses the windings where the magnetomotive force is generated and provides a path for the flux lines to close with minimal leakage. The composite core is configured such that the low permeability material 54 is located where the flux accumulates from the high permeability sections of the core. The low permeability and high saturation flux density of the magnetic material allows it to withstand high magnetic fields without saturation and provide localized energy storage similar to an air gap. An example composite core assembly built on an E-core structure is shown in FIGS. 6*a* and 6*b* for designs that use planar windings 55 and vertical winding 56. A vertical winding design is described in copending US patent application entitled "Vertical Winding Structures for Planar Magnetic Switched-Mode Power Converters", filed Aug. 19, 2004, which is hereby incorporated by reference. For the same reasons related to induced eddy currents in planar windings, vertical windings cannot utilize the full window height and have to be placed far away from the air gap resulting in low power density.

The presence of magnetic material 54 with higher permeability than air in the space where the air gap would have existed keeps the flux confined within the core thereby preventing fringing flux from spilling out into the winding arrangement. Introduction of the low permeability material 54 with a finite saturation flux density to replace the air gap requires careful design of the complete core assembly to ensure that the flux density at each section of the core, in response to the applied magnetic field, does not exceed the saturation limit of the corresponding material used to synthesize that section of the core. Examples of high permeability materials 52 include ferrites, laminated silicon steel and Metglas. Permeability of ferrites is in the 700–2000 range while that of silicon steel and Metglas laminations can be as high as 10,000. Examples of low permeability materials 54 include powdered iron, magnetic nanocomposites and powdered permalloy. The saturation flux density of ferrites is in the 350–450 mT range, while that of laminated silicon steel and Metglas and low permeability materials such as powdered iron, magnetic nanocomposites and powdered permalloy is in the 1–2 T range.

The permeabilities of the two materials that form the composite core should differ significantly to ensure that the energy is stored primarily in the low permeability section of the core. A typical permeability ratio between the two materials is about 20:1 while a ratio is 10:1 is adequate to achieve satisfactory performance. A wide variation in permeability results in the applied magnetomotive force to be almost entirely supported in the low permeability section of the composite core thereby allowing localized energy storage.

All else being equal, the volume of low permeability material 54 is necessarily greater than that of the air gap to compensate for its higher relative permeability and finite saturation flux density. As a result, this composite core configuration balances the requirements of reducing fringing flux to lower eddy current losses and reduce loss of inductance while preventing core saturation without necessarily increasing either the height or width of the core or the number of winding turns.

The composite core 50 is configured such that the low permeability, high saturation material 54 is located where the flux accumulates from the high permeability sections 52. For the E-core structure shown in FIGS. 6*a* and 6*b*, the inductive components of the flux generated in the outer legs 68 and 70 accumulate in the low permeability, high saturation center leg 72. In the case of an isolated power converter topology with integrated magnetics where a one magnetic core is shared between multiple transformers and inductors, there is an additional constraint that the transformer component of the flux should circulate in a high permeability path.

Figure 7A:
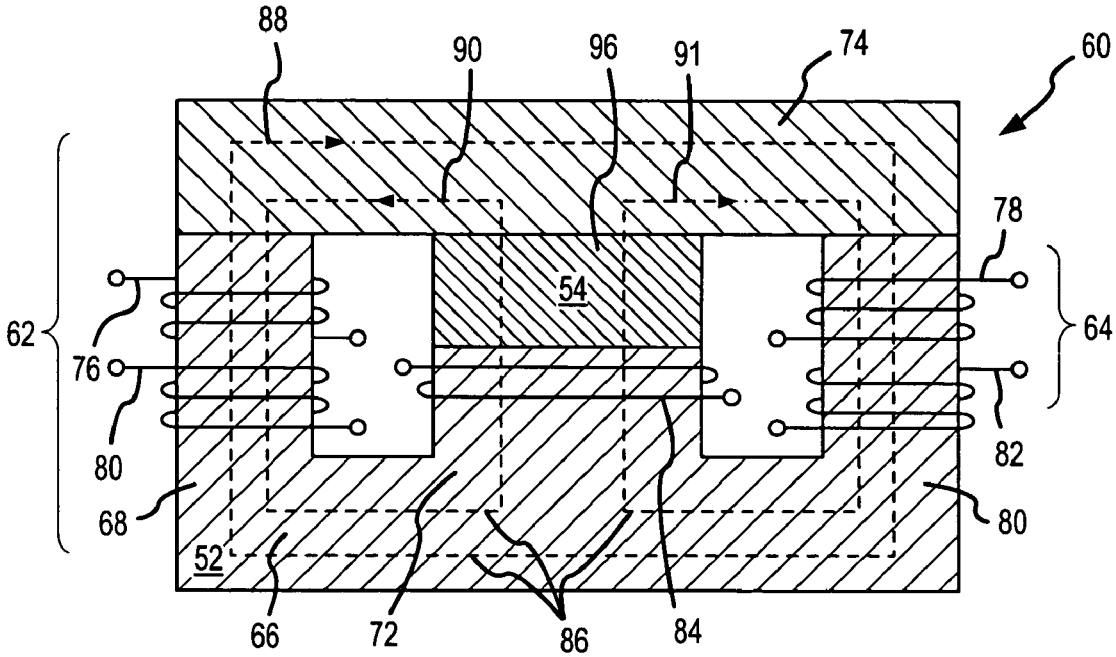
FIGS. 7*a* through 7*b* are section views of a composite "EI" core for use in isolated and non-isolated power converters.
Figure 8A:
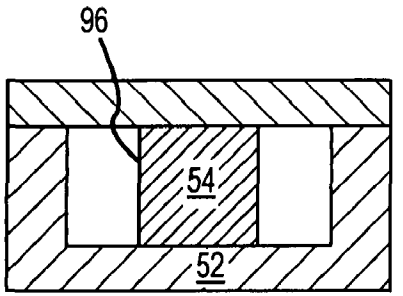
FIGS. 8*a* through 8*c* are section views of alternate composite E-I cores for use in isolated or non-isolated power converter.
Figure 8B:
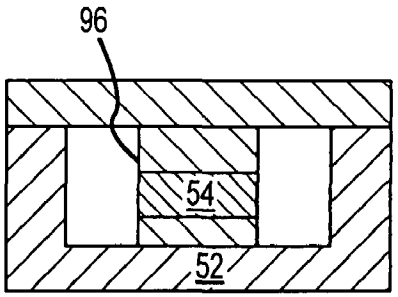
Figure 8C:
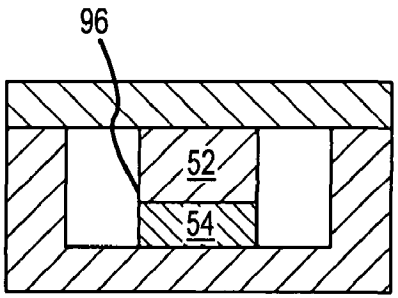

As shown in FIG. 7*a*, a magnetic structure 60 for use in an isolated power converter includes, for example, an E-I core 62 and a winding structure 64. The core includes a base 66, a pair of outer legs 68 and 70, a center leg 72 and a plate 74 that rests on all three legs. The winding structure includes windings 76 and 78 on the outer legs that form a split-primary windings, windings 80 and 82 on the outer legs that function both as secondary side and inductor windings, and a center leg winding 84 that forms an additional inductor winding. The flux 86 includes the transformer component 88 that circulates in the outer legs 68 and 70, the top plate 74 and the base 66 and inductive components 90 and 91 that flow through the outer legs 68, 70, center leg 72, and complete through the top plate 74 and the base 66. The center-leg winding 84 is used to increase the effective filtering inductance and carries the full load current all the time. To simultaneously preserve a high permeability path 94 for the transformer component of the flux and prevent saturation of the core, a portion 96 of the center leg 72 is formed of the low permeability material 54. The remainder of the core is suitably formed from the high permeability material 52. Alternate placements of the high saturation material portion 96 are illustrated in FIGS. 8*a*–8*c* including the entire center leg, a middle portion of the leg or a lower portion of the leg.

Figure 7B:
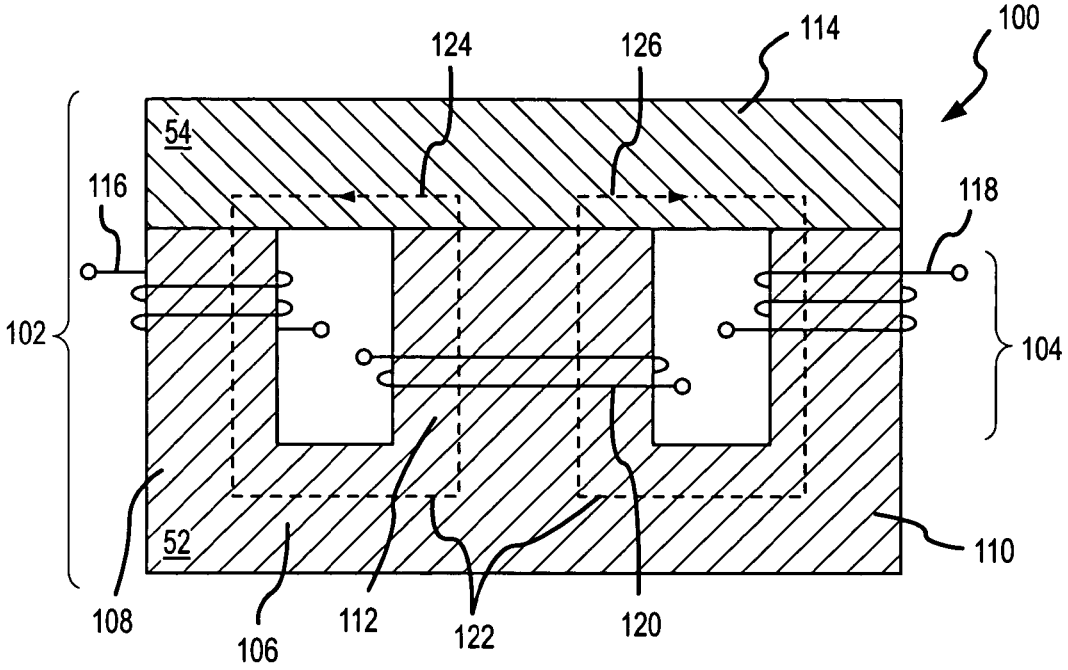
Figure 9A:
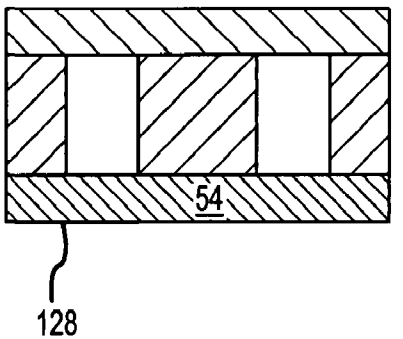
FIGS. 9*a* through 9*c* are section views of additional composite E-I cores for use in non-isolated power converters.
Figure 9B:
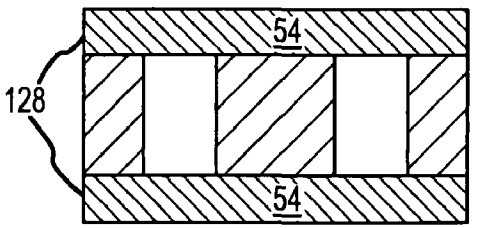
Figure 9C:
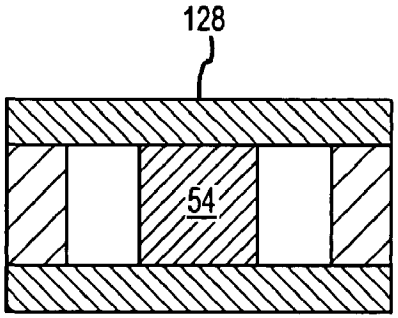

As shown in FIG. 7*b*, a magnetic structure 100 for use in a non-isolated power converter with integrated magnetics includes, for example, an E-I core 102 and a winding structure 104. The core includes a base 106, a pair of outer legs 108 and 110, a center leg 112 and a plate 114 that rests on all three legs. The winding structure 104 includes three inductive windings 116, 118 and 120 wound around the outer and center legs. The flux 122 includes inductive components 124 and 126 that flow through the outer legs 108, 110, center leg 112, and complete through the top plate 114 and the base 116. In this particular core and winding structure, the inductive components of the flux accumulate in the center leg, base and the top plate. Due to the absence of a transformer flux component for the non-isolated converter, there is no requirement to maintain a high permeability path. Hence, a portion 128 of the base, plate and/or the center leg may be formed from the high saturation material 54. The remainder of the core is suitably formed from the high permeability material 52. Alternate placements of the low permeability material 128 are illustrated in FIGS. 9*a*–9*c* including the base, the base and plate, and the base, plate and center leg. The portion could be some or all of these components or combinations thereof. Furthermore, any of the configurations shown in FIGS. 7*a* and 9*a*–9*c* are also suitable for a non-isolated power converter. Core structures shown in FIGS. 7 through 9 are suitable for both planar and vertical winding structures.

If, for example, the low permeability material 54 is used in the center leg of an E-core to replace the air gap therein, a first-order estimate of the height of the low permeability material, is determined by the height of the air gap it is replacing, the relative permeability of the material and cross sectional area of the center leg. Assuming constant cross section and constant number of windings, the estimate is the height of the air gap multiplied by the relative permeability of the material. Since the permeabilities are significantly different, the reluctance of the composite core is determined primarily by that of the low permeability section. Hence, increase in height of the low permeability section of the center leg can be accommodated by proportionally reducing the height of the high permeability section thereby maintaining the overall height of the core constant. The final composite core design including core geometry and dimensions, choice of materials and their corresponding volume fractions and physical location in the core and, number of turns must be determined through a detailed optimization process to achieve the required performance while minimizing overall core volume and weight.

The composite core may be configured in any number of ways to implement a particular winding structure for both isolated and non-isolated power converters. For example, the core may be a conventional "E-I" as illustrated above or a conventional "E—E" structure. Alternately, the core may be formed as a coupled toroid or a matrix integrated magnetics (MIM) structure such as a "rectangular", "radial" or "Extended-E". The MIM core structures are detailed in copending patent applications entitled ""Core Structure", filed Apr. 18, 2002" and "Extended E Matrix Integrated Magnetics (MIM) Core" filed Aug. 19, 2004, which are incorporated by reference. The MIM core provides for ultra-low profile magnetics, resulting in better core utilization, larger inductance, improved efficiency and lower losses over conventional E-core designs. The MIM core can also be configured in a cellular arrangement in a multi-phase configuration to effectively produce output voltages with reduced ripple or in multiple output converters.

Figure 10A:
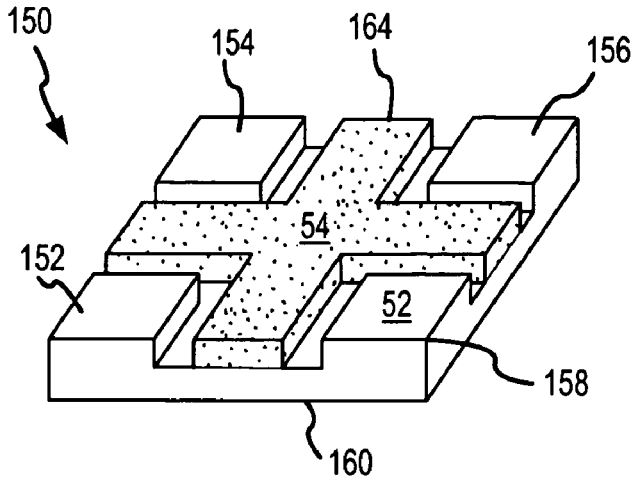
FIGS. 10*a* and 10*b* are perspective views of "+" and "Extended-E" matrix integrated magnetics (MIM) cores.

As shown in FIG. 10*a*, a rectangular MIM core structure 150, provides four outer legs 152, 154, 156 and 158 at the corners of a base 160. A shared center leg 162 in the shape of a cross or "+" is formed at the center of the base. A plate (not shown) rests on top of the four outer legs and shared center leg. In this particular example, the entire shared center leg 164 is formed of a low permeability, high saturation material 54 and the remainder of the core is formed from a high permeability material 52. Alternate embodiments consistent with those shown in FIGS. 7–9 can be used in different power converters.

Figure 10B:
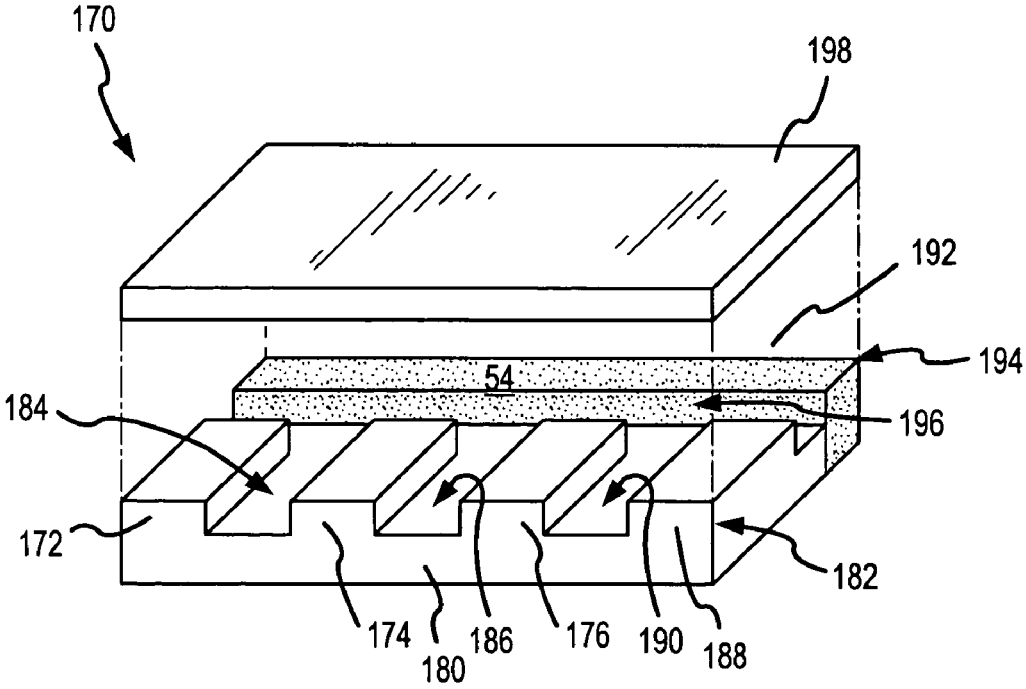

As shown in FIG. 10*b*, an Extended-E core 170 includes at least first, second and third outer legs 172, 174 and 176, respectively, disposed on the top region of a base 180 and separated along a first outer edge 182 to define first, second, . . . windows 184, 186, . . . therebetween. A fourth outer leg 188 and window 190 are also included in this embodiment. A center leg 192, formed from one or more pieces, is disposed on the top region 178 of the base 180 along a second outer edge 194 and separated from the first, second and third legs to define a center window 196. The base 180, outer legs 172, 174, 176 and 188 and the center leg 192 may be produced as an integrated unit or produced separately and joined together. A plate 198 is disposed on the outer and center legs opposite the base. In this particular example, the entire shared center leg 192 is formed of a low permeability high saturation density material 54 and the remainder of the core is formed from a high permeability material 52. Alternate embodiments consistent with those shown in FIGS. 7–9 can be used in different power converters.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A magnetic core, comprising:

a base;

first and second legs on the base and separated from each other;

a center leg on the base and separated from said first and second legs; and a plate on said first, second and center legs opposite the base, wherein a portion of at least one of said base, center leg and said plate comprises a first material having a first magnetic permeability ($\mu_{rel1}$) and a first saturation flux density ($B_{SAT1}$) and the remaining portion of the magnetic core comprises a second material having a second magnetic permeability ($\mu_{rel2}$) greater than the first by at least a factor of 10.

2. The magnetic core of claim 1, wherein said first $B_{SAT1}$ is greater than 450 mT and said first $\mu_{rel1}$ is less than 100 and said second $\mu_{rel2}$ is greater than 1000.

3. The magnetic core of claim 2, wherein the first material is selected from powdered iron, nanomagnetic composites or powdered permalloy and the second material is selected from ferrites, laminated silicon steel or Metglas.

4. The magnetic core of claim 1, further comprising windings around the first and second legs that when energized generate magnetic flux that accumulates in said portion.

5. The magnetic core of claim 4, wherein said windings comprise primary and secondary windings, said portion being in said center leg.

6. The magnetic core of claim 4, wherein said windings comprise inductor windings wound around the first and second legs.

7. The magnetic core of claim 6, further comprising a third inductor winding wound around the said center leg.

8. The magnetic core of claim 5, further comprising a third inductor winding wound around the said center leg.

9. The magnetic core of claim 1, wherein the magnetic core is an E-I or E—E core.

10. The magnetic core of claim 1, further comprising third and fourth legs, said first, second, third and fourth legs disposed at opposite corners of a rectangular base to define windows there between, said center leg disposed at the center of the rectangular base separated from said first, second, third and fourth legs, said plate disposed on said first, second, third and fourth legs.

11. The magnetic core of claim 10, further comprising windings around the first, second, third and fourth legs that when energized produce flux that accumulate in said portion.

12. The magnetic core of claim 11, wherein said windings comprise primary and secondary windings, said portion being a portion of said center leg.

13. The magnetic core of claim 11, further comprising a fifth winding around said center leg.

14. The magnetic core of claim 12, further comprising a fifth winding around the center leg.

15. The magnetic core structure of claim 1, further comprising a third leg, said first, second and third legs separated along a first outer edge of the base to define first and second windows there between, said center leg disposed along a second outer edge of the base and separated from said first, second and third legs to define a center window, said plate disposed on said first, second and third legs.

16. A magnetic core, comprising:

a base;

first and second legs on the base and separated from each other;

a center leg on the base and separated from said first and second legs; and a plate on said first, second and center legs opposite the base, a plurality of windings around the first and second legs that when energized generate flux that adds together at a location in the base, center leg and said plate;

wherein a portion of at least one of said base, center leg and said plate at said location comprises a first material having a first saturation flux density ($B_{SAT1}$) and a first magnetic permeability ($\mu_{rel1}$) and the remaining portion of the magnetic core comprises a second material having a second magnetic permeability ($\mu_{rel2}$) greater than the first by at least a factor of 10.

17. A magnetic core, comprising:

a base;

first and second legs on the base and separated from each other;

a center leg on the base and separated from said first and second legs; and a plate on said first, second and center legs opposite the base, wherein a portion of said center leg comprises a first material having a first saturation flux density ($B_{SAT1}$) and a first magnetic permeability ($\mu_{rel1}$) and the remaining portion of the magnetic core comprises a second material having a second magnetic permeability ($\mu_{rel2}$) greater than the first by at least a factor of 10 and a plurality of primary and secondary windings around the first and second legs that when energized produce a transformer flux component that circulates around the first and second legs, base and plate in a high permeability path and inductor flux components that circulate around said first or second legs, the base, the center leg and the plate in a low permeability path and add together in said portion of said center leg.

18. A magnetic core, comprising:

a base;

a plurality of outer legs located along a first outer edge of the base and separated from each other a center leg on the base and located along an opposite outer edge of the base and separated from the outer legs; and a plate on said outer and center legs opposite the base, a plurality of windings around the outer legs that when energized generate flux that adds together in the base, center leg and said plate;

wherein a portion of at least one of said base, center leg and said plate at said location comprises a first material having a first saturation flux density ($B_{SAT1}$) and a first magnetic permeability ($\mu_{rel1}$) and the remaining portion of the magnetic core comprises a 3 second material having a second magnetic permeability ($\mu_{rel2}$) greater than the first by at least a factor of 10.

19. A magnetic core, comprising:

a base;

a plurality of outer legs located along a first outer edge of the base and separated from each other a center leg on the base and located along an opposite outer edge of the base and separated from the outer legs; and a plate on said outer and center legs opposite the base, wherein a portion of said center leg comprises a first material having a first saturation flux density ($B_{SAT1}$) and a first magnetic permeability ($\mu_{rel1}$) and the remaining portion of the magnetic core comprises a second material having a second magnetic permeability ($\mu_{rel2}$) greater than the first by at least a factor of 10;

a plurality of primary and secondary windings around the outer legs that when energized produce a transformer flux component that circulate around said outer legs, base and plate in a high permeability path and inductor flux components that circulate around said outer legs, the base, the center leg and the plate in a low permeability path and add together in said portion of said center leg.

20. The magnetic core of claim 19, wherein said windings include windings around each outer leg and an additional winding around said center leg.

21. The magnetic core of claim 19, wherein said windings further include a plurality of windings around the said center leg.

* * * * *

UNITED STATES PATENT AND TRADEMARK OFFICE

CERTIFICATE OF CORRECTION

PATENT NO. : 6,980,077 B1
APPLICATION NO. : 10/922068
DATED : December 27, 2005
INVENTOR(S) : Chandrasekaran et al.

Figure 1:
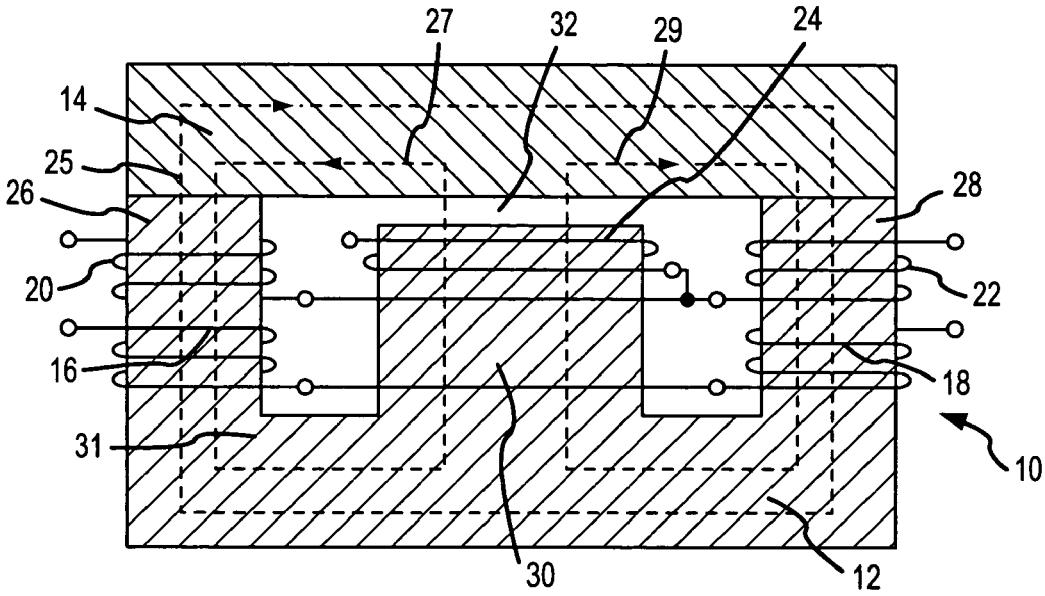
(PRIOR ART) FIG.1
FIG. 1, as described above, is a winding diagram of a standard E-core for use in a current-doubler rectifier (CDR)
Figure 2A:
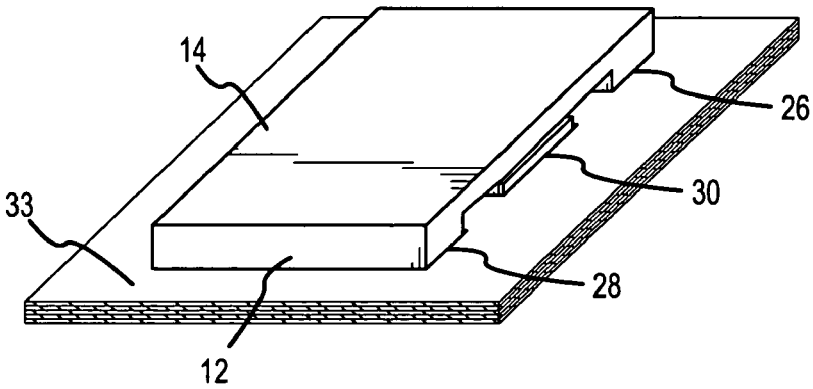
(PRIOR ART) FIG.2a
FIGS. 2*a* and 2*b*, as described above are perspective and section views of a planar magnetic structure using conventional horizontal windings.
Figure 2B:
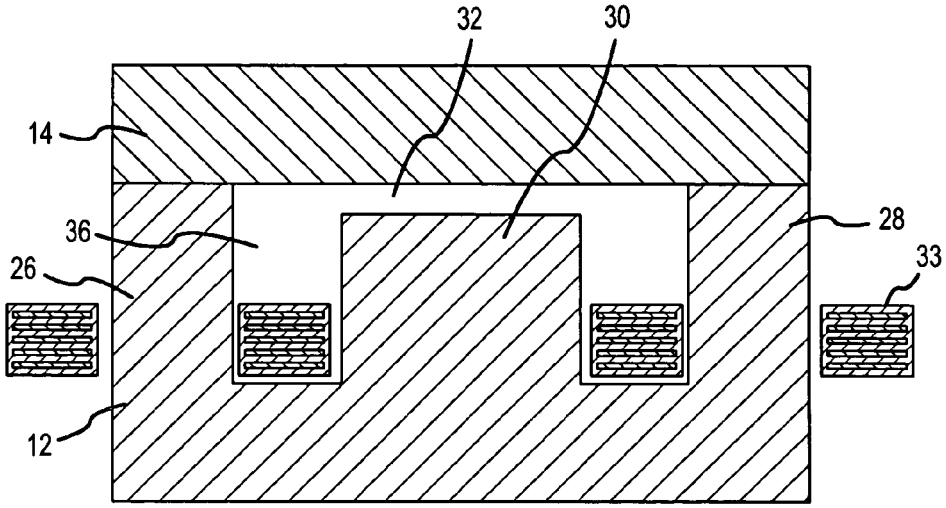
(PRIOR ART) FIG.2b
Figure 3:
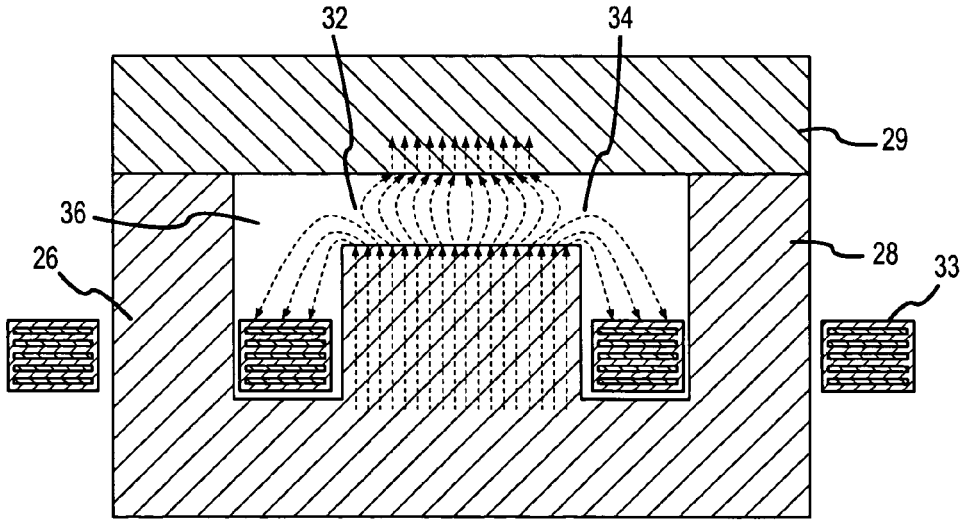
(PRIOR ART) FIG.3
FIG. 3, as described above, is a plot of the fringing flux emanating from the air gap.
Figure 4:
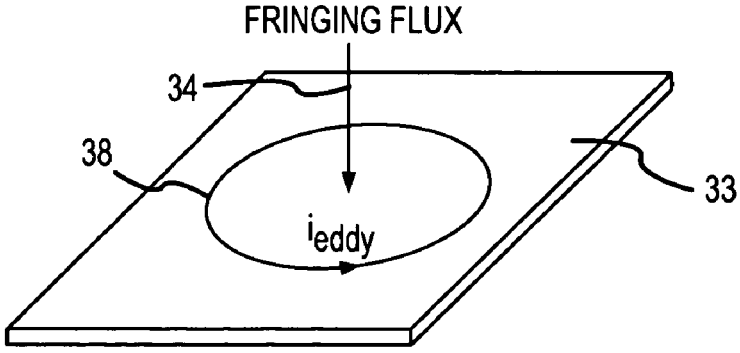
(PRIOR ART) FIG.4
FIG. 4, as described above, is a diagram illustrating the eddy current induced in a horizontal winding by the fringing flux.

It is certified that error appears in the above-identified patent and that said Letters Patent is hereby corrected as shown below:

In the drawings, Fig. 3, delete "29" and insert --14--.
In the drawings, Fig. 7a, delete two occurrences of "80" and insert --70-- in both places.
In Col. 5, line 16, delete "ratio is" and insert --ratio of--.
In Col. 5, line 27, delete "reduce" and insert --a reduced--.
In Col. 6, line 11, delete "116" and insert --106--.
In Col. 7, line 3, delete "162" and insert --164--.
In Col. 7, line 44, after legs; delete "and".
In Col. 7, line 46, delete "base," and insert --base; and--.
In Col. 8, line 13, delete "there between" and insert --therebetween--.
In Col. 8, line 26, delete "the" and insert --said--.
In Col. 8, line 30, delete "there between" and insert --therebetween--.
In Col. 8, line 39, after legs; delete "and".
In Col. 8, line 41, delete "base," and insert --base;--.
In Col. 8, line 41, after base; insert new paragraph return.
In Col. 8, line 44, after plate; insert --and--.
In Col. 8, line 57, after legs; delete "and".
In Col. 8, line 64, after 10; insert --;--.
In Col. 9, line 9, after other; insert --;--.
In Col. 9, line 12, after legs; delete "and".
In Col. 9, line 16, after plate; insert --and--.
In Col. 9, line 21, after a; delete "3".
In Col. 9, line 27, after other; insert --;--.
In Col. 10, line 3, after legs; delete "and".
In Col. 10, line 10, after 10; insert --and--.
In Col. 10, line 13, delete "circulate" and insert --circulates--.

Signed and Sealed this

First Day of June, 2010

David J. Kappos

David J. Kappos
*Director of the United States Patent and Trademark Office*